US009663929B2

(12) United States Patent
Loerch

(10) Patent No.: US 9,663,929 B2
(45) Date of Patent: May 30, 2017

(54) PLUMBING FIXTURE FITTING

(71) Applicant: Moen Incorporated, North Olmsted, OH (US)

(72) Inventor: David C. Loerch, North Olmsted, OH (US)

(73) Assignee: Moen Incorporated, North Olmsted, OH (US)

( * ) Notice: Subject to any disclaimer, the term of this patent is extended or adjusted under 35 U.S.C. 154(b) by 341 days.

(21) Appl. No.: 14/464,818

(22) Filed: Aug. 21, 2014

(65) Prior Publication Data

US 2016/0053471 A1 Feb. 25, 2016

(51) Int. Cl.

| | |
|---|---|
| ***B05B 1/14*** | (2006.01) |
| ***F23D 14/68*** | (2006.01) |
| ***E03C 1/086*** | (2006.01) |

(52) U.S. Cl.

CPC ..... *E03C 1/086* (2013.01)

(58) Field of Classification Search

CPC .. B05B 1/18; B05B 1/185; B05B 1/22; B05B 7/0425; E03C 1/084; E03C 1/086; Y10T 137/9464

USPC ..... 239/428.5, 590

See application file for complete search history.

(56) References Cited

U.S. PATENT DOCUMENTS

| | | | | |
|---|---|---|---|---|
| 2,754,097 | A * | 7/1956 | Hjulian | E03C 1/084 210/198.1 |
| 2,793,016 | A | 5/1957 | Aghnides | |
| 3,642,213 | A | 2/1972 | Parkison et al. | |
| 3,747,856 | A * | 7/1973 | Knapp | E03C 1/084 239/419.5 |
| 4,119,276 | A | 10/1978 | Nelson | |
| 4,537,360 | A | 8/1985 | Bock | |
| 5,143,295 | A | 9/1992 | Okayama et al. | |
| 5,242,119 | A | 9/1993 | Jariyasunant | |
| 5,495,985 | A | 3/1996 | Nehm et al. | |
| 5,769,326 | A | 6/1998 | Muchenberger et al. | |
| 5,803,368 | A | 9/1998 | Shekalim | |
| 6,290,149 | B1 | 9/2001 | Daniel, III et al. | |
| 6,484,953 | B2 | 11/2002 | Freier | |
| 6,695,011 | B2 | 2/2004 | Sochtig | |
| 8,366,019 | B2 | 2/2013 | Lee | |
| 8,439,075 | B2 | 5/2013 | Lin | |
| 8,695,898 | B2 * | 4/2014 | DeVries | E03C 1/08 239/438 |
| 2009/0049600 | A1 | 2/2009 | Weis | |
| 2009/0230216 | A1 * | 9/2009 | Stadtler | E03C 1/084 239/428.5 |
| 2009/0263184 | A1 | 10/2009 | Riedel et al. | |
| 2010/0102145 | A1 * | 4/2010 | Staedtler | E03C 1/08 239/428.5 |
| 2010/0127101 | A1 * | 5/2010 | Stadtler | E03C 1/086 239/428.5 |
| 2010/0213284 | A1 * | 8/2010 | Staedtler | E03C 1/084 239/428.5 |
| 2013/0291977 | A1 | 11/2013 | Chung | |
| 2015/0129684 | A1 * | 5/2015 | Hart | E03C 1/08 239/428.5 |

* cited by examiner

*Primary Examiner* — Justin Jonaitis

(74) *Attorney, Agent, or Firm* — Calfee, Halter & Griswold LLP

(57) ABSTRACT

The present invention provides a plumbing fixture fitting with a rectangular spout tip and opening with a removable flow restrictor and stream straightener.

12 Claims, 8 Drawing Sheets

PLUMBING FIXTURE FITTING

FIELD

The present invention relates generally to a plumbing fixture fitting, and, more particularly, to a plumbing fixture fitting with a rectangular spout tip and opening with a removable flow restrictor and stream straightener.

BACKGROUND

Plumbing fixture fittings that include flow restrictors and/or stream straighteners are known. Flow restrictors restrict the flow from the plumbing fixture fitting. Stream straighteners straighten the flow from the plumbing fixture fitting. These devices can be located in the spout tip opening of the plumbing fixture fitting. These devices need to be removable so that they can be repaired or replaced.

Plumbing fixture fittings that produce a rectangular flow are desired. Difficulties can be encountered in designing plumbing fixture fittings that produce a rectangular flow while accommodating a flow restrictor and a stream straightener that are both removable for repair or replacement.

SUMMARY

The present invention provides a plumbing fixture fitting with a rectangular spout tip and opening with a removable flow restrictor and stream straightener.

In an exemplary embodiment, the plumbing fixture fitting includes a spout body, a flow restrictor, a restrictor housing, and a stream straightener. The spout body includes an inlet, an outlet, and a passageway between the inlet and the outlet. The outlet has a generally rectangular shaped cross-section. The passageway has an attachment portion upstream of the outlet. The flow restrictor is operable to restrict a volume of water flowing to the outlet of the spout body. The stream straightener is operable to straighten water flowing from the outlet of the spout body. At least a portion of the stream straightener has a generally rectangular shaped cross-section. The restrictor housing is operable to receive the flow restrictor. The restrictor housing is operable to be removably secured in the attachment portion of the passageway of the spout body. The stream straightener is operable to be removably secured in the outlet of the spout body. The outlet of the spout body delivers a generally rectangular shaped laminar flow.

In an exemplary embodiment, the plumbing fixture fitting includes a spout body, a flow restrictor, a restrictor housing, and a stream straightener. The spout body includes an inlet, an outlet, and a passageway between the inlet and the outlet. The outlet has a generally rectangular shaped cross-section. The passageway has an attachment portion upstream of the outlet. The attachment portion has a generally circular shaped cross-section. The flow restrictor is operable to restrict a volume of water flowing to the outlet of the spout body. At least a portion of the restrictor housing is generally cylindrical shaped. The stream straightener is operable to straighten water flowing from the outlet of the spout body. At least a portion of the stream straightener has a generally rectangular shaped cross-section. The restrictor housing is operable to receive the flow restrictor. The restrictor housing is operable to be rotatably secured in the attachment portion of the passageway of the spout body. The stream straightener is operable to be removably secured in the outlet of the spout body. The outlet of the spout body delivers a generally rectangular shaped laminar flow.

In an exemplary embodiment, the plumbing fixture fitting includes a spout body, a flow restrictor, a restrictor housing, and a stream straightener. The spout body includes an inlet, an outlet, and a passageway between the inlet and the outlet. The outlet has a generally rectangular shaped cross-section. The passageway has an attachment portion upstream of the outlet. The attachment portion has a generally circular shaped cross-section. The flow restrictor is operable to restrict a volume of water flowing to the outlet of the spout body. The restrictor housing includes a first portion and a second portion. The first portion is generally cylindrical shaped. The stream straightener is operable to straighten water flowing from the outlet of the spout body. The stream straightener includes a first portion and a second portion. The second portion has a generally rectangular shaped cross-section. The first portion of the restrictor housing is operable to receive the flow restrictor. The first portion of the restrictor housing is operable to be rotatably secured in the attachment portion of the passageway of the spout body. The first portion of the stream straightener is operable to be attached to the second portion of the restrictor housing. The restrictor housing is operable to rotate relative to the stream straightener. The second portion of the stream straightener is operable to be removably secured in the outlet of the spout body. The outlet of the spout body delivers a generally rectangular shaped laminar flow.

BRIEF DESCRIPTION OF THE DRAWINGS

-FIG. 4*a* is an exploded perspective view and FIG. 4*b* is an assembled perspective view;

—FIG. 5*a* is a perspective view, FIG. 5*b* is a front view, FIG. 5*c* is a bottom view, and FIG. 5*d* is a cross-sectional view taken along the line 5*d*-5*d* in FIG. 5*b;*

—FIG. 6*a* is a perspective view, FIG. 6*b* is a front view, FIG. 6*c* is a top view, and FIG. 6*d* is a bottom view;

—FIG. 7*a* is a perspective view, FIG. 7*b* is a front view, FIG. 7*c* is a top view, FIG. 7*d* is a bottom view, and FIG. 7*e* is a cross-sectional view taken along the line 7*e*-7*e* in FIG. 7*b*; —FIG. 8*a* is a perspective view, FIG. 8*b* is a front view, FIG. 8*c* is a top view, FIG. 8*d* is a bottom view, FIG. 8*e* is a side view, and FIG. 8*f* is a cross-sectional view taken along the line 8*f*-8*f* in FIG. 8*d*.

DETAILED DESCRIPTION

The present invention provides a plumbing fixture fitting with a rectangular spout tip and opening with a removable flow restrictor and stream straightener. In an exemplary embodiment, the plumbing fixture fitting is a faucet. However, one of ordinary skill in the art will appreciate that the plumbing fixture fitting could be a showerhead, a handheld shower, a body spray, a side spray, or any other plumbing fixture fitting.

Figure 1:
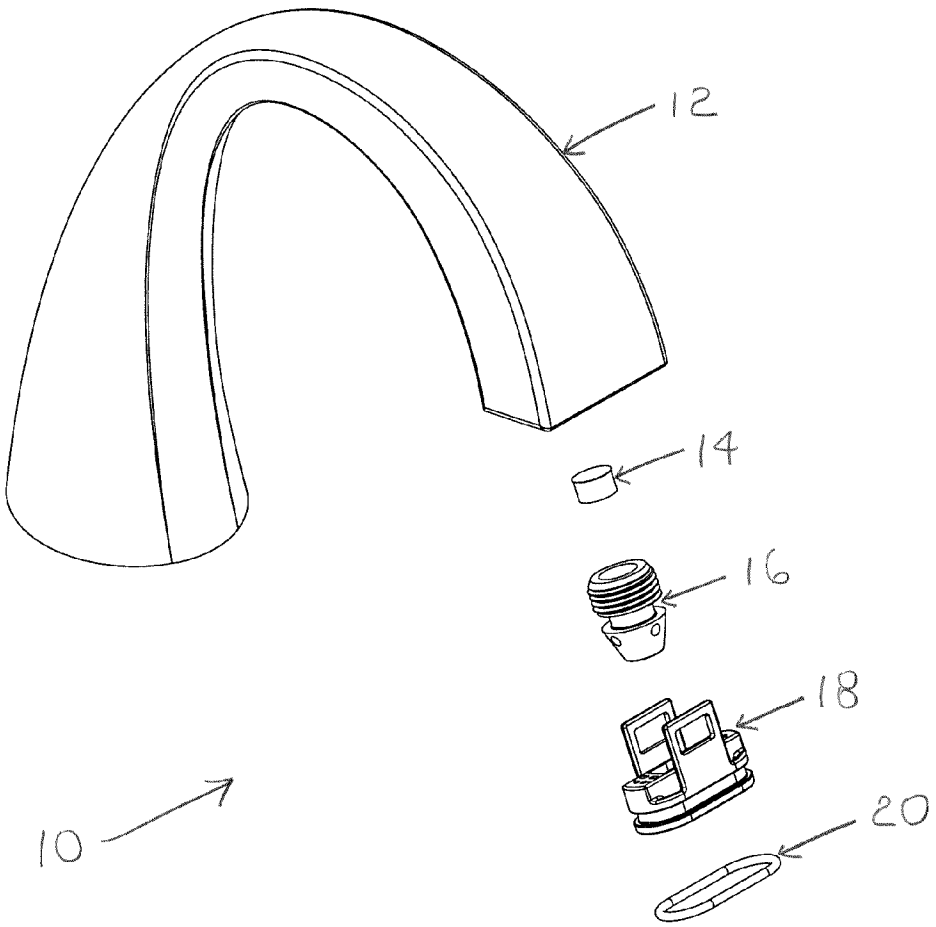
FIG. 1 is an exploded perspective view of a faucet according to an exemplary embodiment of the present invention.
Figures 2A, 2B:
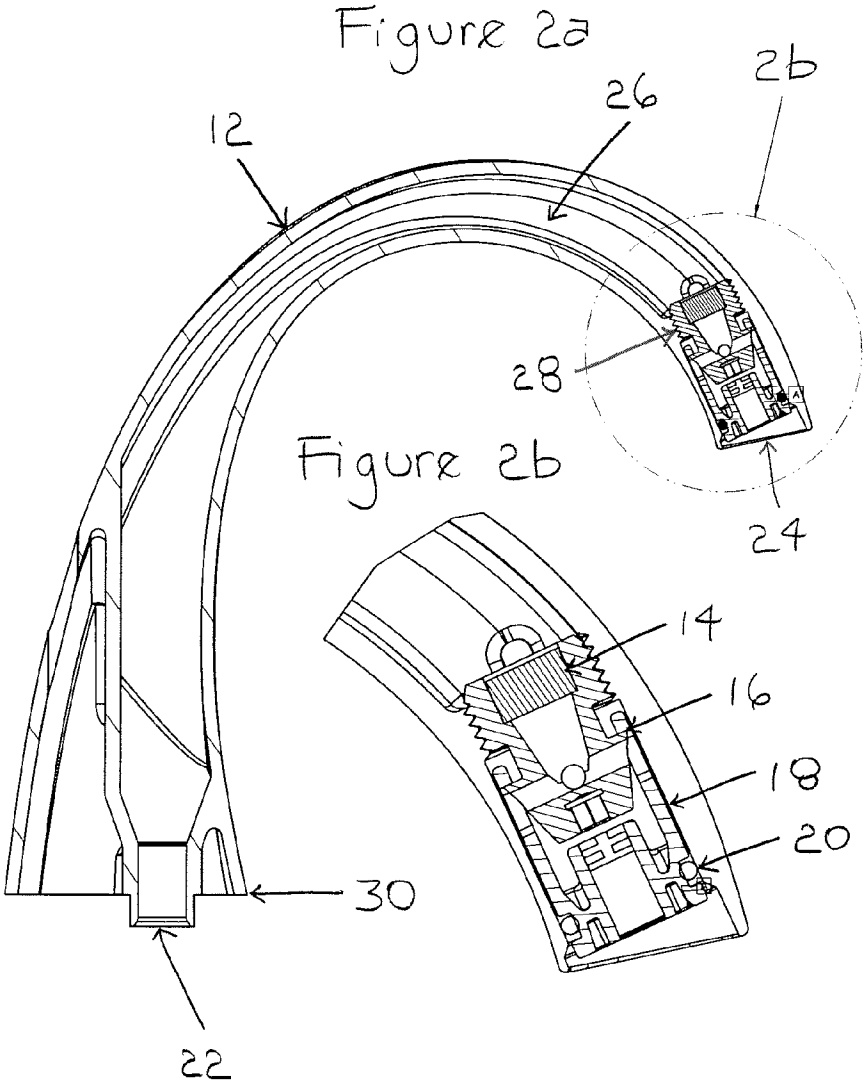
FIGS. 2*a* and 2*b* are cross-sectional side views of the assembled faucet of FIG. 1, FIG. 2*b* showing an enlarged view of the circled portion of FIG. 2*a;*
Figure 3B:
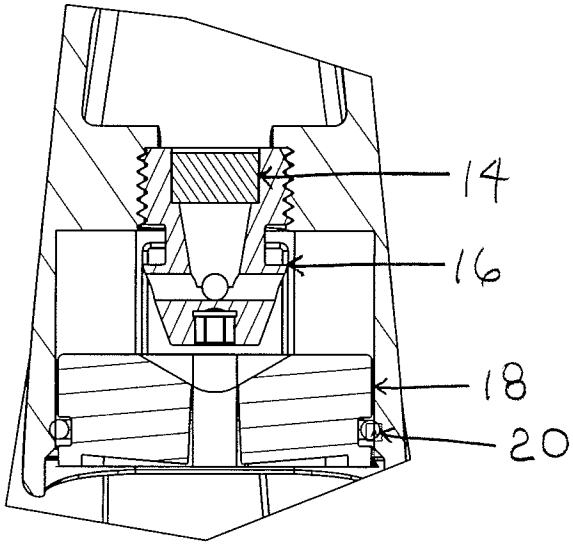
FIGS. 3*a* and 3*b* are cross-sectional front views of the assembled faucet of FIG. 1, FIG. 3*b* showing an enlarged view of the circled portion of FIG. 3*a;*
Figure 3A:
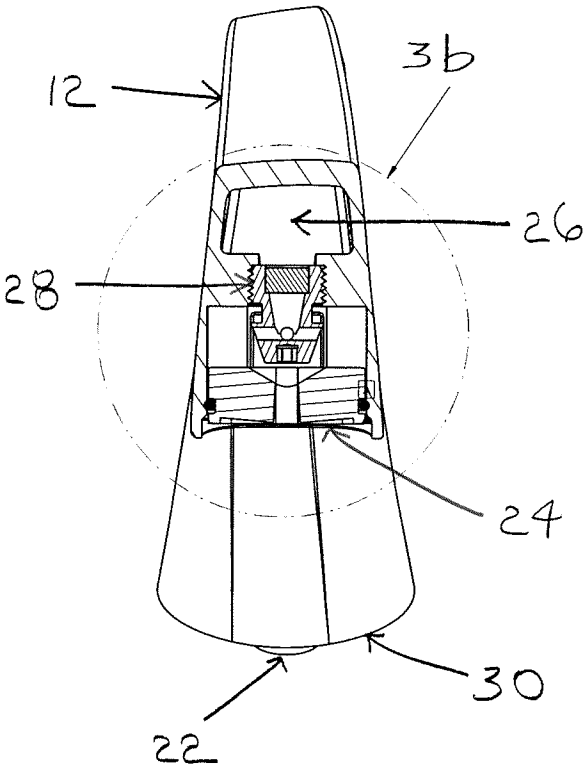

An exemplary embodiment of a faucet 10 of the present invention is shown in detail in FIGS. 1-3*b*. In the illustrated embodiment, the faucet 10 includes a spout body 12, a flow restrictor 14, a restrictor housing 16, a stream straightener 18, and a sealing member (such as an O-ring) 20. The faucet 10 is operable to deliver a generally rectangular shaped laminar flow.

Figure 5A:
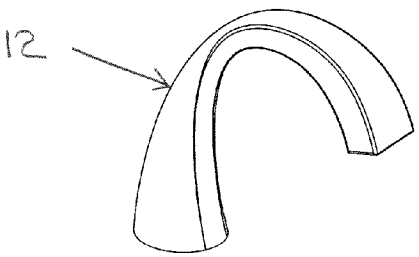
FIGS. 5*a*-5*d* are views of the spout body according to an exemplary embodiment of the present invention
Figure 5B:
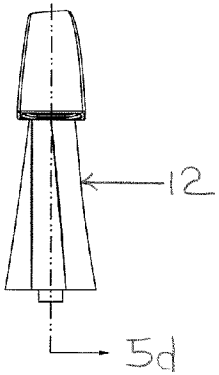
Figure 5C:
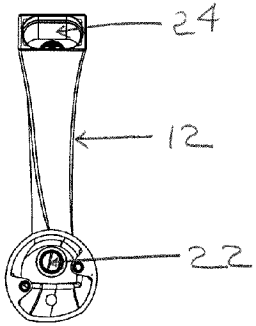
Figure 5D:
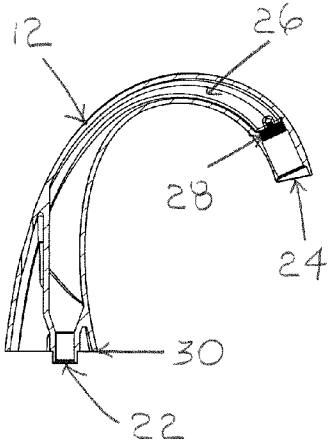

An exemplary embodiment of the spout body 12 is shown in detail in FIGS. 1-3*b* and 5*a*-5*d*. The spout body 12 includes an inlet 22, an outlet 24, and a passageway 26 between the inlet 22 and the outlet 24. In the illustrated embodiment, the outlet 24 has a generally rectangular shaped cross-section. In the illustrated embodiment, the passageway 26 has an attachment portion 28 upstream of the outlet 24. In the illustrated embodiment, the attachment portion 28 has a generally circular shaped cross-section. In the illustrated embodiment, the attachment portion 28 is threaded. A base 30 of the spout body 12 is attached (either directly or indirectly) to a mounting surface (such as a counter or sink).

Figure 4B:
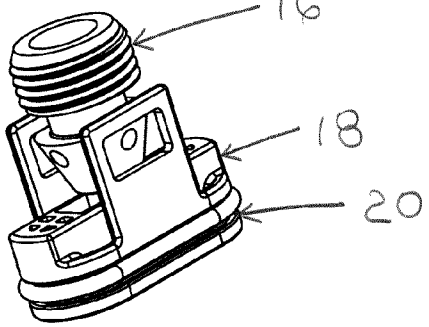
FIGS. 4*a* and 4*b* are views of a flow restrictor, a restrictor housing, a stream straightener, and a sealing member of the faucet of FIG. 1
Figure 4A:
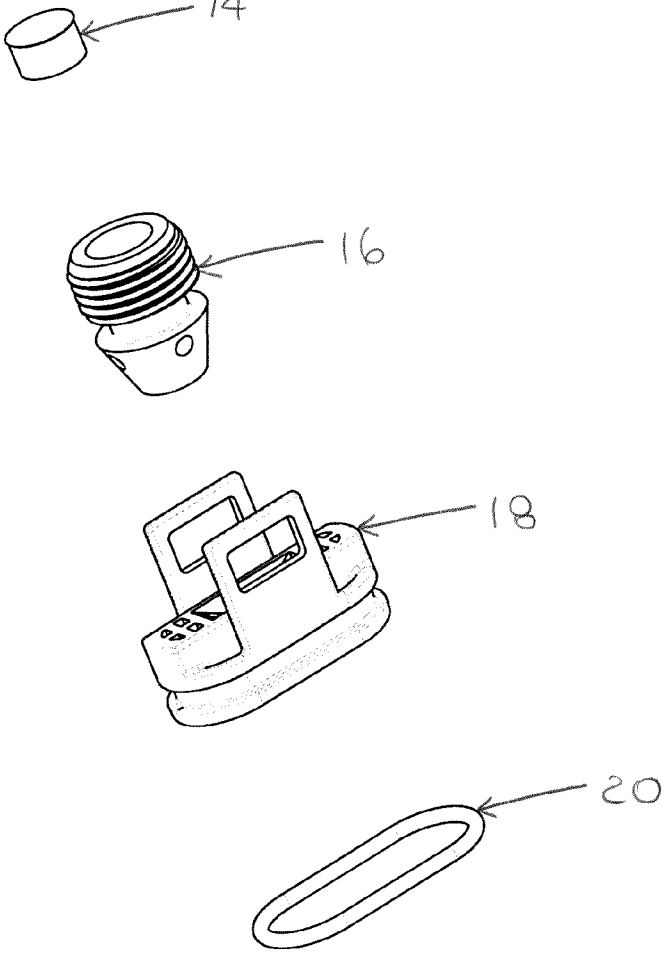
Figure 6A:
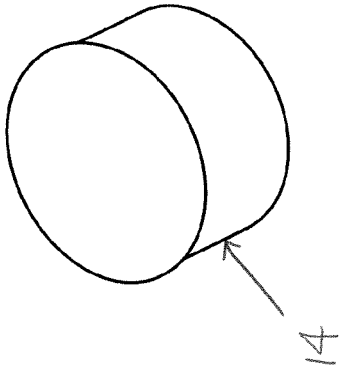
FIGS. 6*a*-6*d* are views of the flow restrictor according to an exemplary embodiment of the present invention
Figure 6C:
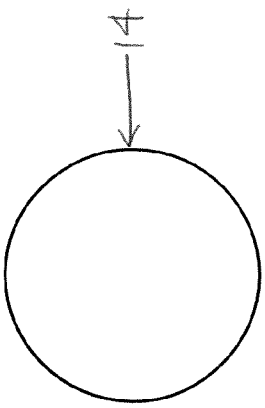
Figure 6B:
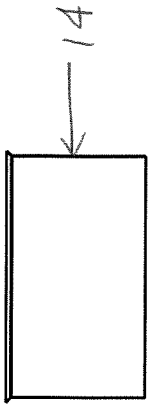
Figure 6D:
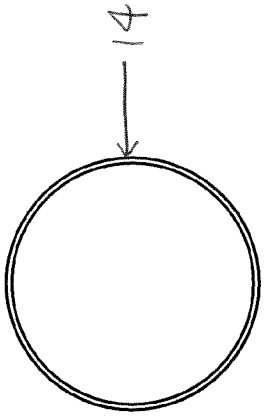

An exemplary embodiment of the flow restrictor 14 is shown in detail in FIGS. 1-4*a* and 6*a*-6*d*. The flow restrictor 14 is operable to restrict a volume of water flowing to the outlet 24 of the spout body 12. In the illustrated embodiment, the flow restrictor 14 is generally cylindrical shaped.

Figure 7A:
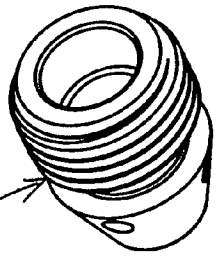
FIGS. 7*a*-7*e* are views of the restrictor housing according to an exemplary embodiment of the present invention
Figure 7E:
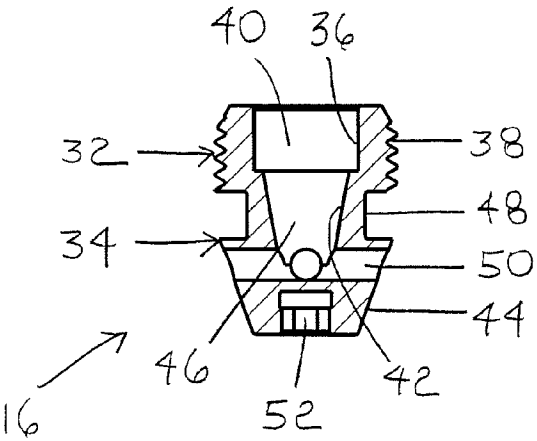
Figure 7C:
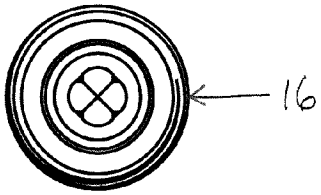
Figure 7B:
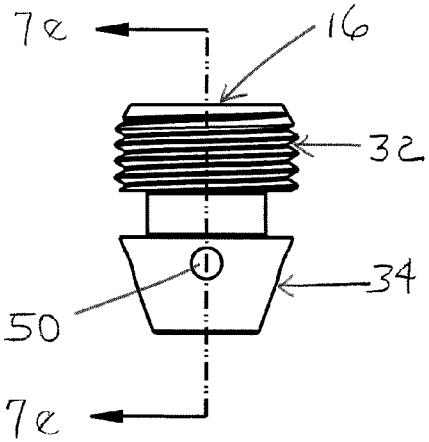
Figure 7D:
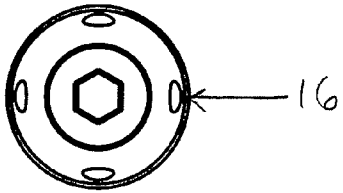

An exemplary embodiment of the restrictor housing 16 is shown in detail in FIGS. 1-4*b* and 7*a*-7*e*. In an exemplary embodiment, the restrictor housing 16 includes a first portion 32 and a second portion 34. In the illustrated embodiment, the first portion 32 is generally cylindrical shaped. The first portion 32 has an inner surface 36 and an outer surface 38. In an exemplary embodiment, the inner surface 36 of the first portion 32 defines a central opening 40. In the illustrated embodiment, the central opening 40 of the first portion 32 is generally cylindrical shaped. In the illustrated embodiment, the outer surface 38 of the first portion 32 is threaded. The second portion 34 has an inner surface 42 and an outer surface 44. In an exemplary embodiment, the inner surface 42 of the second portion 34 defines a central opening 46. In the illustrated embodiment, the central opening 46 of the second portion 34 is slightly tapered. In the illustrated embodiment, the outer surface 44 of the second portion 34 includes a circumferential groove 48. Additionally, in an exemplary embodiment, the second portion 34 includes four radial openings 50 extending from the central opening 46 in the second portion 34 through the outer surface 44 of the second portion 34. Further, in the illustrated embodiment, the second portion 34 includes a central recess 52 in the outer surface 44.

Figure 8A:
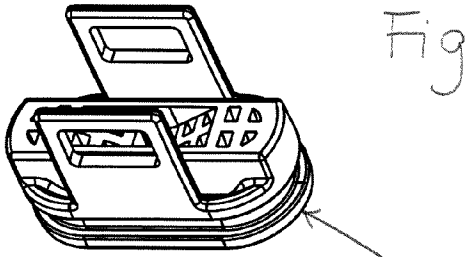
FIGS. 8*a*-8*f* are views of the stream straightener according to an exemplary embodiment of the present invention
Figure 8C:
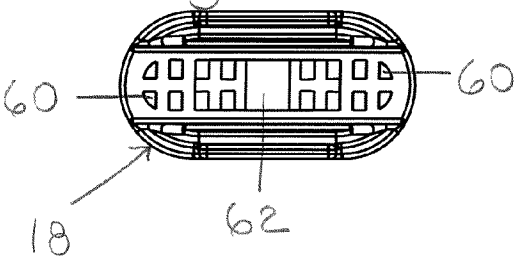
Figure 8B:
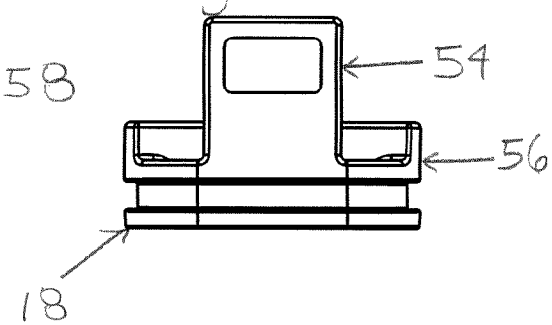
Figure 8E:
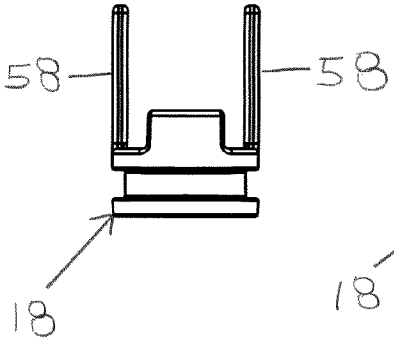
Figure 8D:
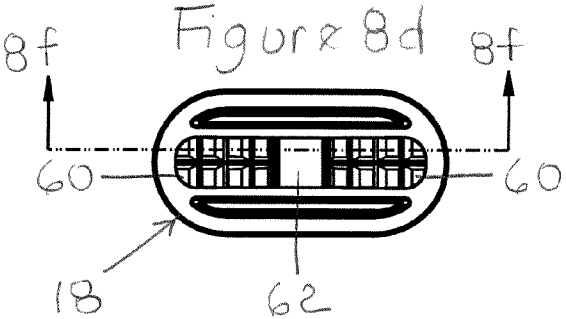
Figure 8F:
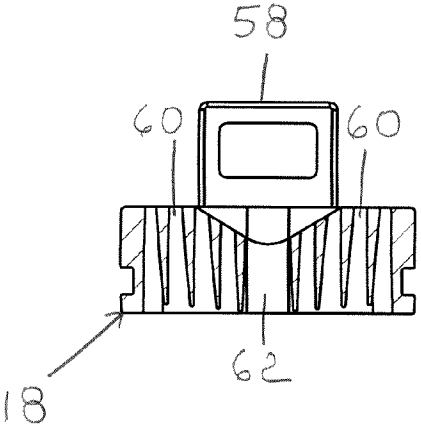

An exemplary embodiment of the stream straightener 18 is shown in detail in FIGS. 1-4*b* and 8*a*-8*f*. The stream straightener 18 is operable to straighten water flowing from the outlet 24 of the spout body 12. In an exemplary embodiment, the stream straightener 18 includes a first portion 54 and a second portion 56. In the illustrated embodiment, the first portion 54 includes two arms 58 projecting upwardly from the second portion 56. In the illustrated embodiment, the second portion 56 has a generally rectangular shaped cross-section. In an exemplary embodiment, the second portion 56 includes a plurality of longitudinal flow openings 60 extending through the second portion 56. Additionally, in the illustrated embodiment, the second portion 56 includes a central opening 62.

In an exemplary embodiment, the first portion 32 of the restrictor housing 16 is operable to receive the flow restrictor 14. In the illustrated embodiment, the central opening 40 in the first portion 32 of the restrictor housing 16 is operable to receive the flow restrictor 14.

In an exemplary embodiment, the restrictor housing 16 is operable to be removably secured in the attachment portion 28 of the passageway 26 of the spout body 12. In an exemplary embodiment, the restrictor housing 16 is operable to be rotatably secured in the attachment portion 28 of the passageway 26 of the spout body 12. In the illustrated embodiment, the first portion 32 of the restrictor housing 16 is operable to be threaded into the attachment portion 28 of the passageway 26 of the spout body 12.

In an exemplary embodiment, the stream straightener 18 is operable to be removably secured in the outlet 24 of the spout body 12. In an exemplary embodiment, the stream straightener 18 is operable to be attached to the restrictor housing 16. In the illustrated embodiment, the circumferential groove 48 in the second portion 34 of the restrictor housing 16 is operable to receive the arms 58 of the first portion 54 of the stream straightener 18. In an exemplary embodiment, the restrictor housing 16 is operable to rotate relative to the stream straightener 18 while the stream straightener 18 is attached to the restrictor housing 16.

In an exemplary embodiment, the assembly of the flow restrictor 14, the restrictor housing 16, and the stream straightener 18 is operable to be removably secured in the attachment portion 28 and the outlet 24 of the passageway 26 of the spout body 12. In the illustrated embodiment, the central opening 62 in the second portion 56 of the stream straightener 18 is operable to receive and the central recess 52 in the second portion 34 of the restrictor housing 16 is operable to engage a tool for threading the first portion 32 of the restrictor housing 16 into the attachment portion 28 of the passageway 26 of the spout body 12.

The assembly of the faucet 10 will now be described. In an exemplary embodiment, the flow restrictor 14 is inserted into the first portion 32 of the restrictor housing 16. In the illustrated embodiment, the flow restrictor 14 is inserted into the central opening 40 in the first portion 32 of the restrictor housing 16. In an exemplary embodiment, the first portion 54 of the stream straightener 18 is attached to the second portion 34 of the restrictor housing 16. In the illustrated embodiment, the arms 58 of the first portion 54 of the stream straightener 18 are inserted into the circumferential groove 48 in the second portion 34 of the restrictor housing 16. In an exemplary embodiment, the assembly of the flow restrictor 14, the restrictor housing 16, and the stream straightener 18 is inserted into the outlet 24 of the spout body 12 and removably secured in the attachment portion 28 of the passageway 26 and the outlet 24 of the spout body 12. In the illustrated embodiment, the assembly of the flow restrictor 14, the restrictor housing 16, and the stream straightener 18 is inserted into the outlet 24 of the spout body 12 and the tool is inserted through the central opening 62 in the second portion 56 of the stream straightener 18 and engaged with the central recess 52 in the second portion 34 of the restrictor housing 16 and turned to thread the first portion 32 of the restrictor housing 16 into the attachment portion 28 of the passageway 26 of the spout body 12.

The operation of the faucet 10 will now be described. When the faucet 10 is turned on, water flows into the inlet 22 of the spout body 12 and through the passageway 26 of the spout body 12. When water reaches the attachment portion 28 of the passageway 26 of the spout body 12, water flows through the flow restrictor 14. Then, water flows into the central opening 46 in the second portion 34 of the restrictor housing 16 and out the radial openings 50 in the second portion 34 of the restrictor housing 16. Next, water flows into and through the longitudinal flow openings 60 in the second portion 56 of the stream straightener 18.

While the faucet 10 has been shown and described in the illustrated embodiment as including certain components, one of ordinary skill in the art will appreciate that the faucet 10 or any other plumbing fixture fitting does not need to include each of these components.

While the faucet 10 has been shown and described in the illustrated embodiment with the components attached in a particular manner, one of ordinary skill in the art will appreciate that the components of the faucet 10 or any other plumbing fixture fitting do not need to be attached in this particular manner.

As an example, in the illustrated embodiment, the restrictor housing is removably secured in the attachment portion of the passageway of the spout body with a threaded connection. However, one of ordinary skill in the art will appreciate that the restrictor housing could be removably secured in the attachment portion of the passageway of the spout body with other connection mechanisms, such as with a bayonet connection.

As another example, in the illustrated embodiment, the stream straightener 18 is attached to the restrictor housing 16 with an arm and groove connection. However, one of ordinary skill in the art will appreciate that the stream straightener 18 could be attached to the restrictor housing 16 with other connection mechanisms. Moreover, one of ordinary skill in the art will appreciate that the stream straightener 18 could be attached to the outlet 24 of the spout body 12 in addition to or instead of the restrictor housing 16. The stream straightener 18 could be attached to the outlet 24 of the spout body 12 with known connection mechanisms, such as an O-ring connection or an O-ring and groove connection.

One of ordinary skill in the art will now appreciate that the present invention provides a plumbing fixture fitting with a rectangular spout tip and opening with a removable flow restrictor and stream straightener. Although the present invention has been shown and described with reference to a particular embodiment, equivalent alterations and modifications will occur to those skilled in the art upon reading and understanding this specification. The present invention includes all such equivalent alterations and modifications.

What is claimed is:

1. A plumbing fixture fitting for producing a generally rectangular shaped laminar flow, comprising:

a spout body, the spout body including an inlet, an outlet, and a passageway between the inlet and the outlet, the outlet having a generally rectangular shaped cross-section, the passageway having an attachment portion upstream of the outlet;

a flow restrictor that is operable to restrict a volume of water flowing to the outlet of the spout body;

a restrictor housing; and a stream straightener that is operable to straighten water flowing from the outlet of the spout body, at least a portion of the stream straightener having a generally rectangular shaped cross-section;

wherein the restrictor housing is operable to receive the flow restrictor;

wherein the restrictor housing is operable to be removably secured in the attachment portion of the passageway of the spout body;

wherein the stream straightener is operable to be removably secured in the outlet of the spout body;

wherein the outlet of the spout body delivers a generally rectangular shaped laminar flow;

wherein the stream straightener is operable to be attached to the restrictor housing;

wherein the restrictor housing has an outer surface including a groove;

wherein the stream straightener includes an arm; and wherein the groove in the restrictor housing is operable to receive the arm of the stream straightener.

2. The plumbing fixture fitting of claim 1, wherein:

the attachment portion of the passageway of the spout body has a generally circular shaped cross-section;

at least a portion of the restrictor housing is generally cylindrical shaped; and the restrictor housing is operable to be rotatably secured in the attachment portion of the passageway of the spout body.

3. The plumbing fixture fitting of claim 2, wherein:

the attachment portion of the passageway of the spout body has a threaded inner surface;

the restrictor housing has a threaded outer surface; and the restrictor housing is operable to be threaded into the attachment portion of the passageway of the spout body.

4. The plumbing fixture fitting of claim 1, wherein the restrictor housing is operable to rotate relative to the stream straightener.

5. A plumbing fixture fitting for producing a generally rectangular shaped laminar flow, comprising:

a spout body, the spout body including an inlet, an outlet, and a passageway between the inlet and the outlet, the outlet having a generally rectangular shaped cross-section, the passageway having an attachment portion upstream of the outlet;

a flow restrictor that is operable to restrict a volume of water flowing to the outlet of the spout body;

a restrictor housing; and a stream straightener that is operable to straighten water flowing from the outlet of the spout body, at least a portion of the stream straightener having a generally rectangular shaped cross-section;

wherein the restrictor housing is operable to receive the flow restrictor;

wherein the restrictor housing is operable to be removably secured in the attachment portion of the passageway of the spout body;

wherein the stream straightener is operable to be removably secured in the outlet of the spout body;

wherein the outlet of the spout body delivers a generally rectangular shaped laminar flow;

wherein the restrictor housing includes a recess;

wherein the stream straightener includes an opening;

wherein the recess in the restrictor housing is operable to engage a tool for securing the restrictor housing in the attachment portion of the passageway of the spout body; and wherein the opening in the stream straightener is operable to receive the tool for securing the restrictor housing in the attachment portion of the passageway of the spout body.

6. A plumbing fixture fitting for producing a generally rectangular shaped laminar flow, comprising:

a spout body, the spout body including an inlet, an outlet, and a passageway between the inlet and the outlet, the outlet having a generally rectangular shaped cross-section, the passageway having an attachment portion upstream of the outlet, the attachment portion having a generally circular shaped cross-section;

a flow restrictor that is operable to restrict a volume of water flowing to the outlet of the spout body;

a restrictor housing, at least a portion of the restrictor housing being generally cylindrical shaped; and a stream straightener that is operable to straighten water flowing from the outlet of the spout body, at least a portion of the stream straightener having a generally rectangular shaped cross-section;

wherein the restrictor housing is operable to receive the flow restrictor;

wherein the restrictor housing is operable to be rotatably secured in the attachment portion of the passageway of the spout body;

wherein the stream straightener is operable to be removably secured in the outlet of the spout body;

wherein the outlet of the spout body delivers a generally rectangular shaped laminar flow;

wherein the stream straightener is operable to be attached to the restrictor housing;

wherein the restrictor housing has an outer surface including a groove;

wherein the stream straightener includes an arm; and wherein the groove in the restrictor housing is operable to receive the arm of the stream straightener.

7. The plumbing fixture fitting of claim 6, wherein:

the attachment portion of the passageway of the spout body has a threaded inner surface;

the restrictor housing has a threaded outer surface; and the restrictor housing is operable to be threaded into the attachment portion of the passageway of the spout body.

8. The plumbing fixture fitting of claim 6, wherein the restrictor housing is operable to rotate relative to the stream straightener.

9. A plumbing fixture fitting for producing a generally rectangular shaped laminar flow, comprising:

a spout body, the spout body including an inlet, an outlet, and a passageway between the inlet and the outlet, the outlet having a generally rectangular shaped cross-section, the passageway having an attachment portion upstream of the outlet, the attachment portion having a generally circular shaped cross-section;

a flow restrictor that is operable to restrict a volume of water flowing to the outlet of the spout body;

a restrictor housing, at least a portion of the restrictor housing being generally cylindrical shaped; and a stream straightener that is operable to straighten water flowing from the outlet of the spout body, at least a portion of the stream straightener having a generally rectangular shaped cross-section;

wherein the restrictor housing is operable to receive the flow restrictor;

wherein the restrictor housing is operable to be rotatably secured in the attachment portion of the passageway of the spout body;

wherein the stream straightener is operable to be removably secured in the outlet of the spout body;

wherein the outlet of the spout body delivers a generally rectangular shaped laminar flow;

wherein the restrictor housing includes a recess;

wherein the stream straightener includes an opening;

wherein the recess in the restrictor housing is operable to engage a tool for securing the restrictor housing in the attachment portion of the passageway of the spout body; and wherein the opening in the stream straightener is operable to receive the tool for securing the restrictor housing in the attachment portion of the passageway of the spout body.

10. A plumbing fixture fitting for producing a generally rectangular shaped laminar flow, comprising:

a spout body, the spout body including an inlet, an outlet, and a passageway between the inlet and the outlet, the outlet having a generally rectangular shaped cross-section, the passageway having an attachment portion upstream of the outlet, the attachment portion having a generally circular shaped cross-section;

a flow restrictor that is operable to restrict a volume of water flowing to the outlet of the spout body;

a restrictor housing, the restrictor housing including a first portion and a second portion, the first portion being generally cylindrical shaped; and a stream straightener that is operable to straighten water flowing from the outlet of the spout body, the stream straightener including a first portion and a second portion, the second portion having a generally rectangular shaped cross-section;

wherein the first portion of the restrictor housing is operable to receive the flow restrictor;

wherein the first portion of the restrictor housing is operable to be rotatably secured in the attachment portion of the passageway of the spout body;

wherein the first portion of the stream straightener is operable to be attached to the second portion of the restrictor housing;

wherein the restrictor housing is operable to rotate relative to the stream straightener;

wherein the second portion of the stream straightener is operable to be removably secured in the outlet of the spout body;

wherein the outlet of the spout body delivers a generally rectangular shaped laminar flow;

wherein the second portion of the restrictor housing has an outer surface including a groove;

wherein the first portion of the stream straightener includes an arm projecting upwardly from the second portion; and wherein the groove in the second portion of the restrictor housing is operable to receive the arm of the first portion of the stream straightener.

11. The plumbing fixture fitting of claim 10, wherein:

the attachment portion of the passageway of the spout body has a threaded inner surface;

the restrictor housing has a threaded outer surface; and the restrictor housing is operable to be threaded into the attachment portion of the passageway of the spout body.

12. A plumbing fixture fitting for producing a generally rectangular shaped laminar flow, comprising:

a spout body, the spout body including an inlet, an outlet, and a passageway between the inlet and the outlet, the outlet having a generally rectangular shaped cross-section, the passageway having an attachment portion upstream of the outlet, the attachment portion having a generally circular shaped cross-section;

a flow restrictor that is operable to restrict a volume of water flowing to the outlet of the spout body;

a restrictor housing, the restrictor housing including a first portion and a second portion, the first portion being generally cylindrical shaped; and a stream straightener that is operable to straighten water flowing from the outlet of the spout body, the stream straightener including a first portion and a second portion, the second portion having a generally rectangular shaped cross-section;

wherein the first portion of the restrictor housing is operable to receive the flow restrictor;

wherein the first portion of the restrictor housing is operable to be rotatably secured in the attachment portion of the passageway of the spout body;

wherein the first portion of the stream straightener is operable to be attached to the second portion of the restrictor housing;

wherein the restrictor housing is operable to rotate relative to the stream straightener;

wherein the second portion of the stream straightener is operable to be removably secured in the outlet of the spout body;

wherein the outlet of the spout body delivers a generally rectangular shaped laminar flow;

wherein the second portion of the restrictor housing includes a recess;

wherein the second portion of the stream straightener includes an opening;

wherein the recess in the second portion of the restrictor housing is operable to engage a tool for securing the first portion of the restrictor housing in the attachment portion of the passageway of the spout body; and wherein the opening in the second portion of the stream straightener is operable to receive the tool for securing the first portion of the restrictor housing in the attachment portion of the passageway of the spout body.

* * * * *